US006098642A

United States Patent [19]

Crane

[11] Patent Number: 6,098,642

[45] Date of Patent: Aug. 8, 2000

[54] COUNTER REVOLUTION SEWER CLEANING NOZZLE

[76] Inventor: Patrick Crane, 3217 Carter Ave., Marina del Rey, Calif. 90292

[21] Appl. No.: 09/222,574

[22] Filed: Dec. 28, 1998

[51] Int. Cl.[7] ..... B08B 9/053

[52] U.S. Cl. ..... 134/167 C; 239/261; 239/DIG. 13

[58] Field of Search ..... 134/167 C, 168 C; 239/DIG. 13, 261; 118/317, DIG. 10; 266/312

[56] References Cited

U.S. PATENT DOCUMENTS

| | | | |
|---|---|---|---|
| 2,601,691 | 7/1952 | Harris et al. | 134/167 C X |
| 4,361,282 | 11/1982 | DiVito | 134/167 C X |
| 4,799,554 | 1/1989 | Clapp et al. | 134/167 C X |
| 5,518,379 | 5/1996 | Harris et al. | 166/312 X |

*Primary Examiner*—Philip R. Coe

*Attorney, Agent, or Firm*—David O'Reilly

[57] ABSTRACT

A counter-rotating sewer cleaning nozzle to provide improved efficient cleaning of interior surfaces of sewer lines. The counter-rotating sewer cleaning nozzle is comprised of a hose connector on one end and nose cone on the opposite end and retaining between them counter-rotating sleeves fitting over a cylindrical conduit. Each of the sleeves has spray jets in communication with a passageway connecting the cylindrical conduit to the hose connector for receiving water at high pressure from a high-pressure hose or pipe. The jets in the counter-rotating sleeves are at an oblique angle to the radius of the sleeves and the cylindrical conduit. The spray jets are angled in opposite directions in the forward and rear rotatable sleeves to provide counter rotation. When water is forced at high pressure through the sewer cleaning nozzle, the nozzle jets rotate the respective counter-rotating sleeves in opposite directions to provide efficient cleaning of crevices and irregular surfaces on interior surfaces of sewer lines.

13 Claims, 2 Drawing Sheets

COUNTER REVOLUTION SEWER CLEANING NOZZLE

BACKGROUND OF THE INVENTION

1. Field of the Invention

This invention relates to sewer cleaning devices and more particularly relates to a counter revolution sewer cleaning nozzle.

2. Background Information

Sewer cleaning nozzles are generally attached to high-pressure water hoses and fed into sewer lines. The nozzle is generally mounted on skids to keep the nozzle centered in the sewer line. High-pressure water is discharged from the sewer cleaning nozzle to force debris ahead of it out of the sewer line. Generally these sewer cleaning nozzles have nozzle jets facing rearward that assist in driving the nozzle along the sewer line. In some cases, the nozzle rotates to spray around the entire diameter of the sewer pipe.

While these sewers are effective and have been used for some time they are not as efficient as they could be. Particularly the non-rotating sewer cleaning nozzle do not always cover the entire interior surface of the sewer pipe effectively. Also, these sewer cleaning nozzles are subject to damage and can be clogged up with debris preventing them from rotating.

One such rotary cleaning nozzle mounted on a skid centering device is disclosed and described in U.S. Pat. No. 2,062,850. Another non-rotating sewer cleaning nozzle carried on skids is disclosed in U.S. Pat. No. 4,073,302. A purported improvement in sewer cleaning nozzles is disclosed and described in U.S. Pat. No. 4,677,977 issued in July 1987. In this device, a high-pressure revolving sewer cleaning nozzle is mounted on a non-rotating base and connected to a high-pressure pipe. The rotatable nozzle has rearward facing jets communicating with the high-pressure pipe through a series of traverse slots that act as turbine blades to rotate a rotary jet member. While this is an improvement, it still is not effective to clean the interior of the pipe both forward and rearward.

It is therefore one object of the present invention to provide an improved sewer cleaning nozzle having counter-rotating sleeves.

Still another object of the present invention is to provide an improved sewer cleaning nozzle having counter-rotating sleeves with jets constructed at an oblique angle to the radius of the nozzle to rotate sections or sleeves on the nozzle in opposite directions providing improved interior surface cleaning of the sewer line.

Yet another object of the present invention is to provide an improved sewer cleaning nozzle having counter-rotating sleeves that can improve cleaning of irregular surfaces in a sewer lines such as shelves or indentations.

Still another object of the present invention is to provide an improved sewer cleaning nozzle having counter-rotating sleeves and a hose connector with rearward facing jets to assist in driving the sewer cleaning nozzle through the sewer line.

BRIEF DESCRIPTION OF THE INVENTION

The purpose of the present invention is to provide an improved sewer cleaning nozzle and more particularly to provide an improved sewer cleaning nozzle having a pair of preferably counter-rotating sleeves that improve efficiency and effective cleaning for the interior of the sewer line.

The improved sewer cleaning nozzle is comprised of a nozzle connector on one end and a nose cone secured on a forward end on a cylindrical conduit to retain a pair of rotatable sleeves. The rotatable sleeves are rotatably mounted on the cylindrical conduit and separated by spacers and plastic bushings to allow them to freely rotate on the conduit.

The cylindrical conduit is comprised of an integrally formed extension on the high-pressure hose connector having a threaded socket on an end opposite the hose connector. A second section of the cylindrical conduit has a threaded nipple for threading into the threaded bore in the hose connector cylindrical extension. The second cylindrical section clamps a spacer between the ends of the hose connector cylindrical extension to separate the counter-rotatable sleeves. The first rotatable sleeve fits between the hose connector and the spacer while the second counter-rotating sleeve fits between the sleeve and a nose cone that retains the rotatable sleeves on the cylindrical conduit.

The hose connector is constructed for connection to a high-pressure hose that feeds high-pressure water to the counter-rotating sleeves. Rearward facing jets connected by an annulus to a chamber in the hose connector ejects water rearward to provide additional sewer line scrubbing and to drive the sewer cleaning nozzle.

The counter-rotating sleeves are driven by a plurality of jets in the side wall of the sleeves that are at an oblique angle to the radius of the sleeve and cylindrical conduit. The rear rotary sleeve has spray jets that eject high-pressure water received through the cylindrical conduit to rotate the sleeve, for example, in a counter-clockwise direction. The forward sleeve has a plurality of oblique spray jets that are angled in the direction opposite from the spray jets in the forward sleeve to eject high-pressure water from the high-pressure hose to rotate the sleeve, for example, in a clockwise direction. The combination of the counter-rotating sleeves spraying water in opposite directions and the hose connector having rearward facing jets provides an efficient cleaning system covering the entire area surface of a sewer line including any irregularities.

The above and other novel features of the invention will be more fully understood from the following detailed description and the accompanying drawings, in which:

DETAILED DESCRIPTION OF PREFERRED EMBODIMENT

Figure 1:
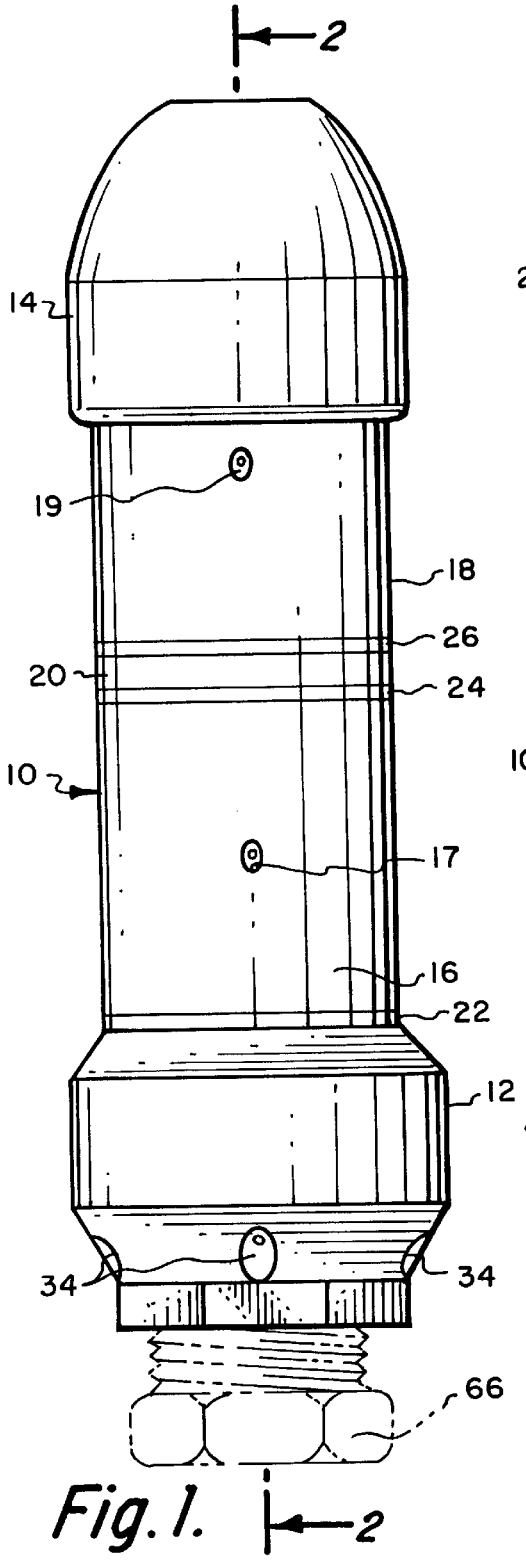
FIG. 1 is a side elevation of a sewer cleaning nozzle constructed according to the invention.

A counter-rotatable nozzle jet assembly 10 constructed according to the invention is illustrated in FIG. 1. The nozzle is generally conventional in shape and design to nozzles presently in use except that it has counter-rotating sleeves and will be disclosed in greater detail hereinafter. Sewer cleaning nozzle jet assembly 10 is comprised of a hose connecting end 12 and a nose cone 14 that retains a rear rotatable sleeve 16 and a forward rotatable sleeve 18 between them. Spacer 20 separates the rear rotatable sleeve 16 and forward rotatable sleeve 18 which are also separated by plastic bushings 22, 24, 26, and 28 (FIG. 2).

Figure 2:
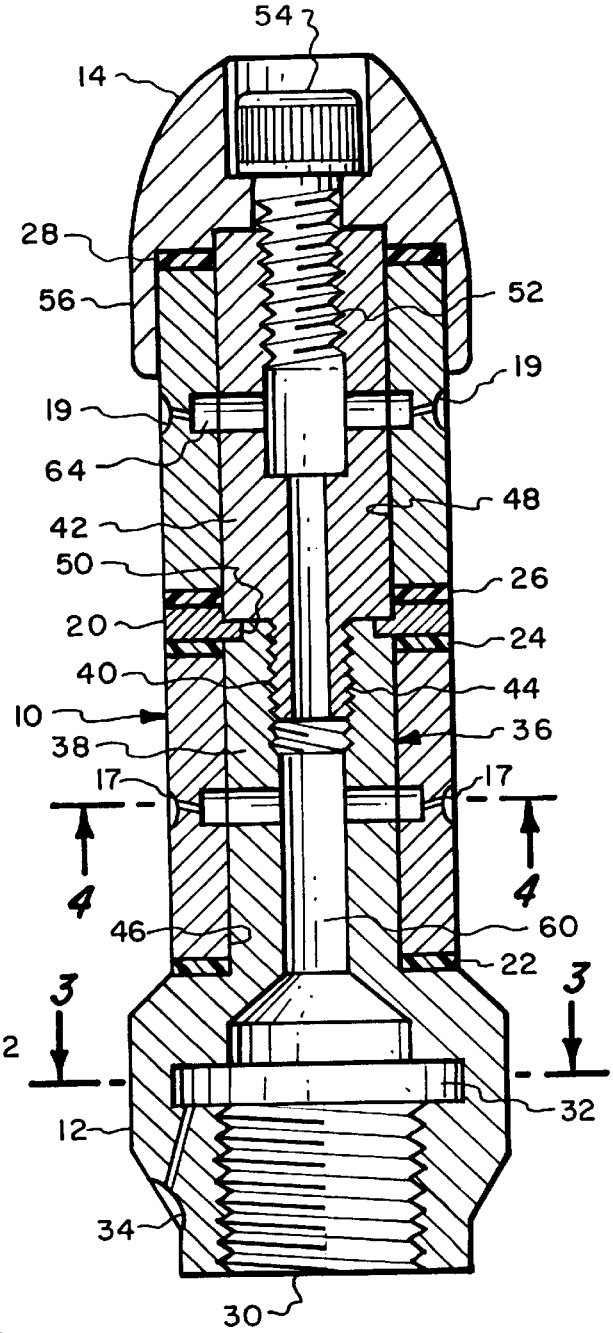
FIG. 2 is a sectional view taken at 2—2 of FIG. 1.
Figure 3:
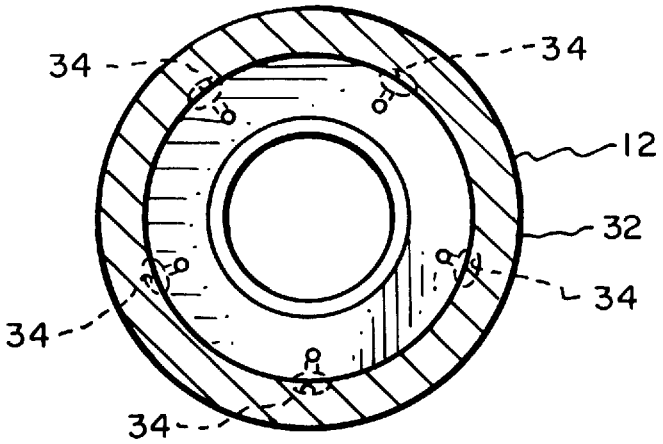
FIG. 3 is a sectional view taken at 3—3 of FIG. 2.
Figure 4:
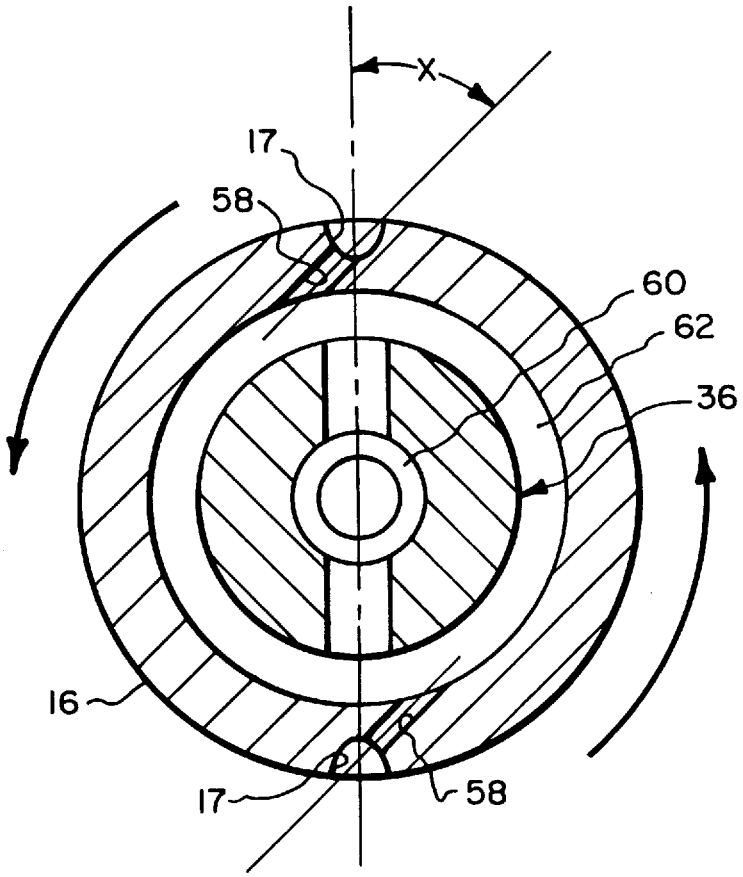
FIG. 4 is an enlarged sectional view taken at 4—4 of FIG. 2.

The construction of the counter-rotatable sewer cleaning nozzle 10 is shown in sectional view of FIGS. 2 through 4.

Hose connecting end 12 has a threaded socket 30 for receiving a high-pressure pipe or hose. Hose connector 12 also has an interior annulus 32 for directing the flow of water to a plurality of rearward facing jets 34 that assist in cleaning and driving the sewer cleaning nozzle 10 forward. Sewer cleaning nozzle 10 of course may be skid mounted as are prior sewer cleaning nozzles in a manner which is known in the art.

Attached to hose connecting end 12 is a cylindrical conduit 36 formed in two sections. Rearward section 38 is formed as an extension of hose connecting end 12 and has a threaded socket 40. Forward cylindrical conduit 42 is provided with a threaded nipple 44 that threads into socket 40 on rear cylindrical conduit 38.

Forward and rear counter-rotating sleeves 16 and 18 slide over rear cylindrical conduit 38 and forward cylindrical conduit 42 and have internal diameters 46 and 48 respectively that are slightly larger than the outside diameters of cylindrical conduit sections 38 and 42. This allows cylindrical sleeves 16 and 18 to freely rotate on cylindrical conduit 36 formed by cylindrical conduit sections 38 and 42. Spacer 20 clamped between rear end of forward cylindrical conduit 42 and forward end of rear cylindrical conduit 38 has a peripheral notch 50. Spacer 20 maintains spacing between counter-rotating sleeves 16 and 18. Plastic bushings 22, 24, 26, and 28 provide sliding surfaces for the ends of counter-rotating sleeves 16 and 18 respectively.

Forward cylindrical conduit section 42 has a threaded bore 52 for receiving a threaded bolt 54 to secure nose cone 14 to nozzle jet assembly 10. Nose cone 14 forms a skirt section 56 surrounding a portion of rotatable sleeve 18 to retain both sleeves 16 and 18 on cylindrical conduit 36. Also threaded bolt 54 allows the counter-rotating sewer cleaning nozzle 10 to be easily disassembled for cleaning after use.

The sectional view of FIG. 3 illustrates the construction of the annulus 32 connecting drive jet nozzles 34 to the chamber formed by threaded socket 30 in hose connector 12. Preferably there are five rearward facing jet nozzles 34 equally spaced around the periphery of hose connecting end of sewer connecting nozzle 10.

An enlarged sectional view of FIG. 4 taken at 4—4 of FIG. 2 illustrates the placement of nozzle jets 17 and 19 in rotating sleeves 16 and 18. Spray nozzle jets 17 are provided in rotatable sleeve 16 that communicate through passageways 58 that are at an oblique angle to the radius of rotatable sleeve 16 and cylindrical conduit 36. Spray jets 17 are connected to fluid passageway 16 through cylindrical conduit 36 (FIG. 2) by annulus 62. Preferably spray jets 17 are at an angle "X" of more than 10° and preferably are at an angle of approximately 15°. Thus, rotatable sleeve 16 in the configuration illustrated in FIG. 4 would rotate counter-clockwise.

Nozzle jets 19 in forward rotatable sleeve 18 are likewise connected to fluid passageway 60 in cylindrical conduit 36 by peripheral annulus 64. Also spray jets 19 are at an oblique angle of approximately 15° to the radius of the cylindrical conduit 36 and sleeve 18 that is opposite to the oblique angle of cylindrical jets 17 which would cause a clockwise rotation. In both rotatable cylindrical sleeves 16 and 18 two nozzle jets 17 and 19 were found sufficient but more could be provided if desired.

In operation sewer cleaning nozzle 10 would be attached to a high-pressure hose threaded into socket 30 or by a hose adapter 66 shown in phantom in FIG. 1 delivering water at high pressure of as much as 1,800 psi to passageway 60 and nozzle jets 17 and 18 in rotatable cylindrical sleeves 16 and 18 and nozzle jets 34 in hose connector 12. The force of the high-pressure water causes rotatable cylindrical sleeves 16 and 18 to rotate on cylindrical conduit 36 in opposite directions while water ejected from spray jets 34 helps force sewer cleaning nozzle 10 through the sewer line and assists in cleaning rearward. Thus a cleaning spray from nozzle jets 17 and 19 provide spray in opposite directions to clear crevices or irregularities, shelves, etc, in the inside surface of a sewer line. Counter-rotating sewer cleaning nozzle jet assembly 10 can, of course, be mounted on a skid as is well known in the art.

Thus there has been described a counter-rotating sewer cleaning nozzle jet assembly having a counter-rotating sleeves to provide more efficient cleaning of the interior surfaces of a sewer line. The sewer cleaning nozzle is comprised of a hose connector, cylindrical conduit for receiving water and high-pressure and counter-rotating sleeves mounted on the cylindrical conduit retained by a nose cone fastened by a bolt. Water from a high pressure hose is forced through the passageway in the nozzle and exits through jets in counter-rotating sleeves providing efficient cleaning of the interior of the surface of the sewer lines.

This invention is not to be limited by the embodiment shown in the drawings and described in the description which is given by way of example and not of limitation, but only in accordance with the scope of the appended claims.

What is claimed is:

1. A sewer cleaning nozzle assembly comprising;

a cylindrical conduit;

a base connection on said cylindrical conduit for connecting a high pressure fluid hose;

an axial fluid passageway through said cylindrical conduit;

a first rotatable sleeve mounted on said cylindrical conduit in abutment with said hose connection;

a second rotatable sleeve mounted on said cylindrical conduit spaced from said first rotatable sleeve;

a nose cone attached to an end of said cylindrical conduit for retaining said first and second rotatable sleeves;

first fluid jet means in said first sleeve at an oblique angle to an axis of said cylindrical conduit;

second fluid jet means in said second sleeve at an oblique angle to an axis of said cylindrical conduit;

whereby high pressure fluid flowing through passageways in said cylindrical conduit is ejected through nose jet means in first and second sleeves causes said sleeves to rotate on said cylindrical conduit.

2. The assembly according to claim 1 in which said second fluid jet means is at an oblique angle to the axis of said cylindrical conduit that is opposite to the oblique angle of said jet means in said first sleeve whereby said first and second sleeves rotate in opposite directions.

3. The assembly according to claim 2 in which said jet means in said first and second sleeves comprises at least two fluid jets.

4. The assembly according to claim 3 in which said at least two fluid jets are diametrically opposed jets.

5. The assembly according to claim 2 including a plurality of rearwardly angled device jets in said hose connecting mans for driving said sewer cleaning nozzle; a fluid annulus connecting said drive jets to said passageways through said cylindrical conduit.

6. The assembly according to claim 2 in which said cylindrical conduit comprises a first cylindrical conduit integrally formed on and extending from said hose connector; and a second cylindrical conduit attached to said first cylindrical conduit.

7. The assembly according to claim 6 in which said second cylindrical conduit has a threaded nipple; said first cylindrical conduit having a threaded hole for receiving said threaded nipple.

8. The assembly according to claim 7 including a spacer clamped between said first cylindrical conduit and said second cylindrical conduit between an end of said first sleeve and an end of said second sleeve.

9. The assembly according to claim 8 in which there are at least five equally spaced jets in said hose connector end of said cleaning nozzle.

10. A sewer cleaning nozzle assembly comprising;

a sewer cleaning nozzle means;

a hose connection end on said sewer cleaning nozzle means;

a nose cone end opposite said hose connecting end;

a cylindrical conduit between said hose connecting end and said nose cone end;

a pair of rotatable cylindrical sleeves rotatably mounted on said cylindrical conduit, between said hose connecting end and said nose cone end;

fluid jet means in each of said rotatable cylindrical sleeves communicating with fluid passageway in said cylindrical conduit and said hose connecting end for receiving high pressure fluid;

said fluid jet means being constructed to drive said rotatable sleeves in opposite directions.

11. The assembly according to claim 10 in which said fluid jet means in said each of said rotatable sleeves comprise; at least two fluid jets in a first rotatable cylindrical sleeve at an oblique angle to an axis of said cylindrical conduit; and at least two fluid jets in a second rotatable cylindrical sleeve at an oblique angle to a radius of said cylindrical conduit; said at least two fluid jets in said second rotatable cylindrical sleeve being at an oblique angle that is opposite to the oblique angle of said at least two cylindrical jets in said first rotatable cylindrical sleeve.

12. The assembly according to claim 11 in which said oblique angle is at least 10° to said radius of said cylindrical conduit.

13. The assembly according to claim 12 in which said oblique angle is 15°.

* * * * *